US006698880B1

(12) United States Patent
Campbell et al.

(10) Patent No.: US 6,698,880 B1
(45) Date of Patent: Mar. 2, 2004

(54) POROUS INKJET RECORDING SYSTEM COMPRISING INK-PIGMENT-TRAPPING SURFACE LAYER

(75) Inventors: Bruce C. Campbell, Rochester, NY (US); James A. Reczek, Rochester, NY (US); Lisa B. Todd, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/251,936

(22) Filed: Sep. 20, 2002

(51) Int. Cl.[7] ..... B41J 2/01

(52) U.S. Cl. ..... 347/105; 347/101; 347/100; 428/32.1

(58) Field of Search ..... 347/101, 105, 347/100; 428/195, 32.1, 32.16, 32.34, 32.17

(56) References Cited

U.S. PATENT DOCUMENTS 6,332,679 B1 * 12/2001 Higuma et al. ..... 347/102
6,409,334 B1 6/2002 Campbell et al.
6,447,881 B1 * 9/2002 Nishida et al. ..... 428/195
6,503,606 B1 * 1/2003 Sato et al. ..... 428/195
6,605,337 B1 * 8/2003 Mori et al. ..... 428/195
2003/0039808 A1 * 2/2003 Ichinose et al. ..... 347/105

FOREIGN PATENT DOCUMENTS

WO WO 99/03685 1/1999
WO WO 99/33669 7/1999
WO WO 01/38102 5/2001

* cited by examiner

*Primary Examiner*—Stephen D. Meier
*Assistant Examiner*—Manish Shah
(74) *Attorney, Agent, or Firm*—Chris P. Konkol

(57) ABSTRACT

An inkjet recording system comprising a pigment-based ink in combination with a recording element having a porous substrate with relatively large pores and a relatively thin overlying surface layer which traps pigment particles, from an applied pigmented ink, at or near the surface while not unduly restricting ink flow into the underlying porous substrate.

49 Claims, No Drawings

POROUS INKJET RECORDING SYSTEM COMPRISING INK-PIGMENT-TRAPPING SURFACE LAYER

FIELD OF THE INVENTION

An inkjet recording system comprising an inkjet recording element for use with a pigment-based ink is disclosed. In particular, the recording element has a porous substrate with relatively large pores and a relatively thin porous overlaying surface layer which traps pigments, from an applied pigmented ink, at or near the surface while not unduly restricting ink flow into the underlying porous substrate.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

Inks used in various inkjet printers can be classified as either dye-based or pigment-based. In dye-based inks, the colorant is molecularly dispersed or solvated by a carrier medium. In pigment-based inks, the colorant exists as discrete particles. It is known that pigment-based inks perform better than dye-based inks with respect to stability properties such as light fade or ozone fade.

An inkjet recording element typically comprises a support having on at least one surface thereof an ink-receiving or image-forming layer. The ink-receiving layer can be either porous or swellable.

In general, porous inkjet receivers absorb ink much faster than swellable inkjet receivers. This allows handling of the print sooner. Also, the propensity of image artifacts such as coalescence are reduced. There are many porous inkjet receivers available today. They include porous glossy receivers comprised of small (<200 nm) inorganic particles and binder. The void space created between the particles allow ink to penetrate into the structure. In addition, small pore sizes caused by the packing of the inorganic particles prevents the pigments in the ink from penetrating into the porous structure. This results in high image density. However, the small pores in the structure together with the slower absorbing pigmented inks slow down the rate at which the ink can be absorbed. This slow-down in ink flux is often below the acceptable levels for high speed printing and can result in coalescence as well as poor dry times. Although it is known that larger pores allow ink to be absorbed faster, as predicted by the well-known Lucas-Washburn equation for describing fluid flow in a cylinder, the tradeoff is lower image density.

Other porous receivers include matte-type inkjet receivers. These are often comprised of larger inorganic particles (>1 micron) and binder. In this case, the void space between particles is typically larger than described above. Although the rate of ink penetration can be faster than with the smaller inorganic particles, the larger pore sizes still allow the pigments from the ink to penetrate deeper into the porous structure. Thus, this still results in lower image densities.

WO Patent Number 99/03685 discloses an inkjet printable microporous film comprised of a so-called fluid management system and a so-called pigment management system for use with pigmented inkjet inks. The patent teaches impregnating a microporous structure with pigment-mordanting materials such as silica or metal salts. Since the mordanting materials are contained throughout the microporous structure, the pigments can still penetrate into the microporous structure. Thus, this still results in a lower image density than if the pigment particles stayed on the surface.

WO Patent Number 99/33669 discloses a fibrous inkjet printing media that has been treated with a positively charged species in order to make the pigments in jetted inks bind to the fibers of the media. While this improves the waterfastness of the inks in the media, the pigment particles can still penetrate into the fibrous structure yielding a lower image density than if the pigment particles stayed at the surface.

WO Patent Application Number 01/38102 A1 discloses a silica-filled microporous substrate having an organometallic multivalent metal salt on the silica surface of the silica-filled microporous substrate for improved image waterfastness when printed with pigmented inks. In this case, the pore size is relatively small (<100 nm) and is the same at the surface as well as throughout the entire microporous substrate structure. Pigments from the jetted ink will stay at the surface, due to the relatively small pore size, resulting in good image density. However, the small pore sizes throughout the microporous substrate will restrict the rate of ink flow into the substrate when compared to substrates with larger pore sizes.

U.S. Pat. No. 6,409,334 discloses an inkjet recording element that provides a fast ink dry time and good image density, which element comprises an ink-permeable polyester substrate comprising a base polyester layer and an ink-permeable upper polyester layer. The upper polyester layer comprises a continuous polyester phase having an ink absorbency rate resulting in a dry time of less than about 10 seconds and a total absorbent capacity of at least about 14 $cc/m^2$, the substrate having thereon a porous image-receiving layer characterized by interconnecting voids. However, the porous imaging-receiving layer on the surface was not designed to trap ink pigment particles at the surface for optimal image density and also allow for quick ink absorption rates.

In view of the above, there is a need for an inkjet printing system having a porous inkjet receiver designed specifically for pigmented inks, which receiver produces high-density and long-lasting images with fast ink absorption rates.

SUMMARY OF THE INVENTION

It is a purpose of this invention to provide an inkjet recording system comprising a pigment-based ink and a inkjet recording element. In particular, the recording element is comprised of a porous substrate with relatively large pores and a relatively thin overlying porous surface layer that traps pigment particles from an applied pigmented ink, at or near the surface, while not unduly restricting ink flow into a porous underlying substrate.

Another aspect of the present invention relates to an inkjet printing method, comprising the steps of a) providing an inkjet printer that is responsive to digital data signals; b) loading the printer with an inkjet recording element according to the present invention; c) loading the printer with a pigment-based ink; and d) printing on the ink-receiving layer of the inkjet recording element using the inkjet ink in response to the digital data signals.

DETAILED DESCRIPTION OF THE INVENTION

As indicated above, the present invention relates to an inkjet recording system in which the recording element comprises at least two layers: a porous ink-pigment-trapping surface layer and an underlying porous base unit layer. The ink-pigment-trapping surface layer has a thickness that is smaller than the porous base unit layer. The ink-pigment-trapping surface layer has a median pore size, $r_1$, that is less than the median pore size, $r_2$, of the porous base layer. The median pore size of the ink-pigment-trapping surface layer is approximately the size of the pigment particles used in the ink. This size of the pores is necessary to trap pigment particles near the surface, thus yielding a high print density of colorant.

The ink-pigment-trapping surface layer has a thickness less than three microns, preferably 0.25 to 2.5 microns, most preferably 1 to 2 microns, wherein the median pore diameter in the ink-pigment-trapping surface layer is less than 500 nm, preferably 10 nm to 200 nm, most preferably 25 nm to 125 nm. In order to trap the pigment particles, in the applied inks, on the surface of the recording element, the ratio of the median pore diameter of the ink-pigment-trapping surface layer and the median pigment particle size needs to be less than 1.5, preferably less than 1.1.

The porous base unit layer is a relatively thicker layer comprising interconnecting pores having a total void volume of at least 20 $cm^3/m^2$, preferably 40 to 150 $cm^3/m^2$, most preferably 50 to 100 $cm^3/m^2$, wherein the ratio of the median pore diameter throughout the porous base unit layer to the ink-pigment-trapping surface layer is between 2.0 and 20, preferably at least 3.0, most preferably 3.5 to 15. If the ratio is greater than 20, the ink absorption time is too slow. On the other hand, if the ratio of the median pore diameter in the ink-trapping surface layer to the median particle size in the pigment ink is greater than 1.5, the pigment particles may not be efficiently trapped at the surface, leading to low print density.

It is important that the porous base unit layer have relatively large pores for sufficiently rapid removal of the ink fluid off of the surface. Suitably, the median pore size throughout the porous base unit layer is 200 nm to 3000 nm, preferably 300 to 2500 nm, most preferably 400 to 2000 nm.

It is also important that the porous base unit layer has enough porosity or void volume to readily absorb the amount of ink applied to create various images. Typically this means that the underlayer has a void volume capacity of 20 $cm^3/m^2$ or greater as measured by mercury intrusion porosimetry.

Porous base substrate: The materials useful for making the porous base substrate (also referred to as a porous base unit layer) may include, but are not limited to, open-cell voided polymeric films, cellulosic fiber paper, synthetic non-woven fibrous sheets, foamed films, the non-skin portion of a microporous polymeric membranes, sheets made up of inorganic and/or organic particles and combinations thereof. The porous base unit layer may contain one or more distinct layers, which may be manufactured, or incorporated into the recording element, as a single layer or a plurality of layers. However, the unit layer comprises interconnecting pores throughout the entire unit layer. Thus, for example, if a porous layer is coextruded with a non-porous or non-voided layer or film, the non-porous film is not considered part of the porous base unit layer.

Preferably, in the case of an open-cell voided polymeric film, the film comprises a polyester or polyolefin or copolymers thereof. An example of an open-cell voided copolymer film is a voided polyester film such as described in U.S. Pat. No. 6,409,334. This porous polyester base unit layer is coextruded with a non-voided polyester support layer.

In other embodiments of the invention, the porous base unit layer can comprise cellulosic fiber paper that may be optionally resin coated (on the side opposite the ink-trapping surface layer) with plastic polyethylene layer for water resistance.

In another embodiment, the porous base unit layer can comprise a synthetic non-woven fibrous sheet. For example, the fibrous sheet can be a spun polyolefin. An example of this is Tyvek® sheet material (commercially available from E. I. Du Pont de Nemours and Company).

In still another embodiment, the porous base unit layer can comprise a foamed film, for example, polyethylene, which optionally may be further supported, for example, on paper or polyester. See, for example, U.S. Pat. No. 5,869,544; 5,677,355; and 6,353,037, relating to examples of various techniques for open-cell foaming, which patents are hereby incorporated by reference in their entirety.

Still another embodiment of the present invention involves the use of a porous base unit layer that comprises the base portion (non-skin portion) of a microporous polymeric membrane filter material. A microporous polymeric membrane filter material is generally formed from a synthetic plastic or cellulose-derived material. It usually consists of two layers: a thin porous skin layer on top of a porous base unit layer. Both layers having a substantially uniform, continuous matrix structure containing millions of capillary pores. Such materials are typically made by casting a solution of the polymer in a solvent for the polymer onto the surface of a travelling backing belt in the form of a thin, continuous layer of the polymer solution. The process may typically further comprise passing the belt and thus carrying the layer into and through a formation bath comprising a liquid that is not a solvent for the polymer but that is miscible with the solvent, to form the layer into a porous membrane, with a consequent migration of the solvent liquid from the layer into the formation bath and an enrichment of the composition of the formation bath in the solvent. Thereafter, such as process may involve removing solvent from the porous membrane and drying it.

Such a microporous polymeric membrane filter materials typically comprise voided phase-inverted cellulosic derivatives, nylons, polyesters, vinyl polymers, and copolymers, and the like. Preferably, the microporous polymeric membrane filter material is selected from the group consisting of polyvinylidene fluoride, polycarbonate, and esters of cellulose. An example of this type of material is an MF Millipore® membrane filter (Millipore Corporation).

In still another embodiment of the invention, the porous base unit layer can comprises inorganic and/or organic particles in a binder. Preferably, such a layer is provided on a support, which can, for example, be cellulosic paper, RC paper, synthetic paper, or a polyester film. Suitably, the combination of particles and binder comprises from 50% to 95% of particles and from 50% to 5% of a polymeric binder. The inorganic particles in the porous base unit layer can, for example, comprise silica, alumina, titanium dioxide, clay, calcium carbonate, barium sulfate and/or zinc oxide. The organic particles can, for example, be made from polyester, polyurethane and/or an acrylic polymers.

The polymeric binder can be hydrophilic in nature, for example, poly(vinyl alcohol), hydroxypropyl cellulose, hydroxypropyl methyl cellulose, a poly(alkylene oxide), poly(vinyl pyrrolidinone), poly(vinyl acetate) or copolymers thereof, and/or gelatin. The polymeric binder may also be hydrophobic in nature. Examples of hydrophobic binders include poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, and/or a copolymer of vinylacetate and n-butylacrylate.

In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like may be used. Preferably, the crosslinker is an aldehyde, an acetal or a ketal, such as 2,3-dihydroxy-1,4-dioxane.

The inkjet recording element of the invention can optionally further comprise a separate support beneath the porous base unit layer and includes those intended for reflection viewing, wherein the support may be opaque, and those intended for viewing by transmitted light, wherein the support is transparent support. Thus, the porous base unit layer may optionally be coextruded, laminated, or coated with an adjacent non-porous underlying layer. In most cases, the boundary line between the porous base unit layer and the next adjacent non-porous layer can be easily observed by cross-sectional microscopy. Thus, the boundary line can be definitely determined by the requirement that the base unit layer be porous throughout the unit layer, whether a single observable distinct porous layer or several observable distinct porous layers.

As indicated above, it may be desirable for the porous base unit layer or substrate to be placed over, or on, a support, which support can be made of various relatively rigid materials. (Such optional "supports" are below the porous base unit layer, although it should be understood that the porous base unit layer may serve as the function of the support in some embodiments.) Further layers can include antistat or anticurl layers (for example, polyethylene or hydrogel to counter shrink.). Optional supports for the inkjet recording element of the invention can be any of those supports usually employed in inkjet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint.

The optional support used in the invention may have a thickness of from about 50 to about 500 $\mu$m, preferably from about 75 to 300 $\mu$m. Antioxidants, antistatic agents, plasticizers and other known additives may be incorporated into the support, if desired.

Ink-pigment-trapping surface layer: Materials useful for making the ink-pigment-surface trapping layer include, but are not limited to, the skin-portion of a microporous polymeric membrane material, open-cell voided polymeric films, nanofibers, microfibers or the combinations thereof, foamed films, sheets made up of inorganic and/or organic particles, and/or combinations thereof. In addition, the ink-pigment-trapping surface layer can have properties that improve pigment affinity for the surface, pigment stability, general aesthetics (such as gloss or color), ink wetting, layer adhesion to substrate, layer compatibility to substrate and manufacturability. Pigment affinity for the surface can often be enhanced by adding cationic or anionic functionality (depending on the charge of the ink pigments) to the layer to attract or mordant the pigments.

One preferred embodiment involves the use of an ink-pigment-trapping surface layer that comprises the skin portion of a microporous polymeric membrane filter material. Such microporous polymeric membrane filter materials typically comprise phase-inverted cellulosic derivatives, nylons, polyesters, vinyl polymers and copolymers, and the like. Preferably, the microporous polymeric membrane filter material is selected from the group consisting of polyvinylidene fluoride, polycarbonate (a type of polyester), and esters of cellulose. An example of this is a MF Millipore® membrane filter (Millipore Corporation).

A microporous polymeric membrane material, in which the porous base unit layer and the ink-pigment-trapping surface layers are simultaneously made, is generally formed from a synthetic plastic or cellulose-derived material. The pore diameters in the surface layer or skin tends to be very uniform, within narrow limits. Such types of materials are known to be useful in analytical chemistry for separation of materials into a filtrant and filtrate. Such filters function as an absolute screen or sieve. They retain on their surface all particles larger than the pore diameter. Such microporous polymeric membrane filters are available with average pore sizes in the range from about 25 nanometers (0.025 micrometers or 250 Angstrom units) up to a maximum size on the order of about 10 micrometers. A microporous polymeric membrane filter is generally given an absolute pore size rating, and it will retain all particles larger than that pore diameter. Skinned molecular filters retain most molecules above a nominal or approximate limit, as well as some fraction of smaller molecules.

Microporous polymeric membrane materials that can be used in the present invention are commercially available, for use as filters, from Millipore, Osmonics and other companies. Techniques for making microporous polymeric membrane filters can be found in each of the following U.S. Pat. Nos. 3,100,721; 3,208,875; 3,642,648; and 3,876,738, and U.S. Pat. No. 4203847, hereby incorporated by reference in their entirety. Thus, for example, U.S. Pat. No. 3,100,721 describes a technique for making an unsupported microporous film from any one of a wide spectrum of polymers, including, among others, nylons, polyesters, vinyl polymers, and copolymers, and the like.

In one embodiment, the inkjet recording media can be made from the same material as the filters, except made into standard sheets. Alternatively, it can be laminated onto a support, for example, paper or synthetic paper, polyester, or resin coated paper.

A skinned porous membrane consists of a thin polymeric film or skin that is supported on and integral with a highly porous substrate. The substrate contributes strength and durability to the membrane pigment-filter material, but the thin porous skin is the actual molecular filtration membrane, in this case pigment-trapping membrane. The porous skin layer is densely structured to be able to retain molecules, but is very thin, typically less than two micrometers. Because it is so thin, its resistance to flow is minimized. Since the skin is backed by a very open, porous substrate layer, flow rates through the membrane are high. Retained pigment molecules or particles are held at the surface of the membrane, on its skin, and do not enter into the porous structure.

In one embodiment of the invention, the porous pigment-ink-trapping layer comprises from 20% to 100% of inorganic or organic particles and from 0% to 80% of a polymeric binder, preferably from 80% to 95% of particles and from about 20% to 5% of a polymeric binder. The inorganic particles in the ink-pigment-trapping surface layer can suitably comprise, for example, silica, alumina, titanium dioxide, clay, calcium carbonate, barium sulfate and/or zinc oxide. Organic particles can suitably include, for example, polyester, polyurethane and/or an acrylic polymer. The polymeric binder can be hydrophilic in nature, for example, poly(vinyl alcohol), hydroxypropyl cellulose, hydroxypropyl methyl cellulose, a poly(alkylene oxide), poly(vinyl pyrrolidinone), poly(vinyl acetate) or copolymers thereof, or gelatin. The polymeric binder may also be hydrophobic in nature. Examples of hydrophobic binders include poly (styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate or a copolymer of vinylacetate and n-butylacrylate.

In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate and the like may be used. Preferably, the crosslinker is an aldehyde, an acetal or a ketal, such as 2,3-dihydroxy- 1,4-dioxane.

In another embodiment, the ink-pigment-trapping surface layer can comprise microfibers and/or nanofibers, which are fine fibers that can be made into a non-woven fine-fiber layer. This can be applied, for example, as a coating onto the underlying layer or porous substrate. It is also possible to laminate. A variety of materials can be used, including inorganic materials such as fiberglass, nano alumina fibers, nano silica tubes and ceramic fibers, and a wide range of polymeric compositions.

The term "nanofiber" refers to elongated structures having a cross-section (angular fibers having edges) or diameter (rounded) less than 1 micron. The term "microfiber" refers to fibers with diameter larger than 1 micron, but not larger than 10 microns. This fine fiber can be made in the form of an improved single or multi-layer microfiber structure. Such fine-fiber layers can comprise a random distribution of fine fibers which can be bonded to form an interlocking net. Pigment trapping is obtained largely as a result of the fine-fiber barrier to the passage of pigment particles. The fine-fiber interlocking networks have relatively small spaces between the fibers. Such spaces typically range, between fibers, of about 0.01 to about 25 microns or often about 0.1 to about 10 microns. Preferably, the fine fiber adds less than 3 microns in thickness to the overall inkjet media.

Polymer materials that can be used in the polymeric compositions of the nanofiber or microfiber include both addition polymer and condensation polymer materials such as polyolefin, polyacetal, polyamide, polyester, cellulose ether and ester, polyalkylene sulfide, polyarylene oxide, polysulfone, modified polysulfone polymers and mixtures thereof. Preferred materials that fall within these generic classes include polyethylene, polypropylene, poly (vinylchloride), polymethylmethacrylate (and other acrylic resins), polystyrene, and copolymers thereof (including ABA type block copolymers), poly(vinylidene fluoride), poly(vinylidene chloride), polyvinylalcobol in various degrees of hydrolysis in crosslinked and non-crosslinked forms.

In another embodiment, the ink-pigment-trapping surface layer can comprise a voided polymeric film which is voided by inorganic or organic particles. The voiding process is often accomplished by uniaxial or biaxial orientation.

In still another embodiment, the ink-pigment-trapping surface layer can comprise a foamed film, for example, as referred to above with respect to the porous base unit layer, except having finer pores.

In addition to the primary material used in the ink-pigment-trapping surface layer, the ink-pigment-trapping surface layer can further comprise a mordant for providing pigment affinity for the surface of the layer as will be known to the skilled artisan. For example, a mordant can comprise a cationic or anionic functionality depending on the charge of the ink pigments. Examples of cationic mordant include metal atom containing groups and quaternary ammonium groups.

Pigment based inks: The pigment used in the current invention can be either self-dispersible pigments such as those described in U.S. Pat. No. 5,630,868, encapsulated pigments as those described in the pending U.S. patent application Ser. No. 09/822,723, or can be stabilized by a dispersant. The process of preparing inks from pigments commonly involves two steps: (a) a dispersing or milling step to break up the pigment to the primary particle, and (b) dilution step in which the dispersed pigment concentrate is diluted with a carrier and other addenda to a working strength ink. In the milling step, the pigment is usually suspended in a carrier (typically the same carrier as that in the finished ink) along with rigid, inert milling media. Mechanical energy is supplied to this pigment dispersion, and the collisions between the milling media and the pigment cause the pigment to deaggregate into its primary particles. A dispersant or stabilizer, or both, is commonly added to the pigment dispersion to facilitate the deaggregation of the raw pigment, to maintain colloidal particle stability, and to retard particle reagglomeration and settling.

Pigments which may be used in the invention include organic and inorganic pigments, alone or in combination, such as those as disclosed, for example in U.S. Pat. Nos. 5,026,427; 5,086,698; 5,141,556; 5,160,370; and 5,169,436. The exact choice of pigments will depend upon the specific application and performance requirements such as color reproduction and image stability. Pigments suitable for use in the present invention include, for example, azo pigments, monoazo pigments, disazo pigments, azo pigment lakes, β-Naphthol pigments, Naphthol AS pigments, benzimidazolone pigments, disazo condensation pigments, metal complex pigments, isoindolinone and isoindoline pigments, polycyclic pigments, phthalocyanine pigments, quinacridone pigments, perylene and perinone pigments, thioindigo pigments, anthrapyrimidone pigments, flavanthrone pigments, anthanthrone pigments, dioxazine pigments, triarylcarbonium pigments, quinophthalone pigments, diketopyrrolo pyrrole pigments, titanium oxide, iron oxide, and carbon black. Typical examples of pigments which may be used include Color Index (C.I.) Pigment Yellow 1, 2, 3, 5, 6, 10, 12, 13, 14, 16, 17, 62, 65, 73, 74, 75, 81, 83, 87, 90, 93, 94, 95, 97, 98, 99, 100, 101, 104, 106, 108, 109, 110, 111, 113, 114, 116, 117, 120, 121, 123, 124, 126, 127, 128, 129, 130, 133, 136, 138, 139, 147, 148, 150, 151, 152, 153, 154, 155, 165, 166, 167, 168, 169, 170, 171, 172, 173, 174, 175, 176, 177, 179, 180, 181, 182, 183, 184, 185, 187, 188, 190, 191, 192, 193, 194; C.I. Pigment Orange 1, 2, 5, 6, 13, 15, 16, 17, 17:1, 19,22,24,31, 34,36,38,40,43,44,46, 48, 49, 51, 59, 60, 61, 62, 64, 65, 66, 67, 68, 69; C.I. Pigment Red 1, 2, 3,4, 5, 6, 7, 8, 9, 10, 11, 12, 13, 14, 15, 16, 17, 18, 21, 22, 23, 31, 32, 38, 48:1, 48:2, 48:3, 48:4, 49:1, 49:2, 49:3, 50:1, 51, 52:1, 52:2, 53:1, 57:1, 60:1, 63:1, 66, 67, 68, 81, 95, 112, 114, 119, 122, 136, 144, 146, 147, 148, 149, 150, 151, 164, 166, 168, 169, 170, 171, 172, 175, 176, 177, 178, 179, 181, 184, 185, 187, 188, 190, 192, 194, 200, 202, 204, 206, 207, 210, 211, 212, 213, 214, 216, 220, 222, 237, 238, 239, 240, 242, 243, 245, 247, 248, 251, 252, 253, 254, 255, 256, 258, 261, 264; C.I. Pigment Violet 1, 2, 3, 5:1, 13, 19, 23, 25, 27, 29, 31, 32, 37, 39, 42, 44, 50; C.I. Pigment Blue 1, 2, 9, 10, 14, 15:1, 15:2, 15:3, 15:4, 15:6, 15, 16, 18, 19, 24:1, 25, 56, 60, 61, 62, 63, 64, 66; C.I. Pigment Green 1, 2, 4, 7, 8, 10, 36, 45; C.I. Pigment Black 1, 7, 20, 31, 32, and C.I. Pigment Brown 1, 5, 22, 23, 25, 38, 41, 42. In a preferred embodiment of the invention, the pigment employed is C.I. Pigment Blue 15:3, C.I. Pigment Red 122, C.I. Pigment Yellow 155, C.I. Pigment Yellow 74, bis(phthalocyanylalumino) tetraphenyldisiloxane or C.I. Pigment Black 7.

The aqueous carrier medium for ink compositions suitably employed in the invention is water or a mixture of water and at least one water miscible co-solvent. Selection of a suitable mixture depends on the requirements of the specific application, such as desired surface tension and viscosity, the selected pigment, drying time of the pigmented inkjet ink, and the type of paper onto which the ink will be printed. Representative examples of water-miscible co-solvents that may be selected include (1) alcohols, such as methyl alcohol, ethyl alcohol, n-propyl alcohol, isopropyl alcohol, n-butyl alcohol, sec-butyl alcohol, t-butyl alcohol, iso-butyl alcohol, furfiiryl alcohol, and tetrahydrofurfuryl alcohol; (2) ketones or ketoalcohols such as acetone, methyl ethyl ketone and diacetone alcohol; (3) ethers, such as tetrahydrofuran and dioxane; (4) esters, such as ethyl acetate, ethyl lactate, ethylene carbonate and propylene carbonate; (5) polyhydric alcohols, such as ethylene glycol, diethylene glycol, triethylene glycol, tetraethylene glycol, propylene glycol, polyethylene glycol, glycerol, 2-methyl-2,4-pentanediol 1,2,6-hexanetriol and thioglycol; (6) lower alkyl mono- or di-ethers derived from alkylene glycols, such as ethylene glycol mono-methyl (or -ethyl) ether, diethylene glycol mono-methyl (or -ethyl) ether, diethylene glycol mono-butyl (or -ethyl) ether, propylene glycol mono-methyl (or -ethyl) ether, poly(ethylene glycol) butyl ether, triethylene glycol mono-methyl (or -ethyl) ether and diethylene glycol di-methyl (or -ethyl) ether; (7) nitrogen containing cyclic compounds, such as pyrrolidone, N-methyl-2-pyrrolidone, and 1,3-dimethyl-2-imidazolidinone; and (8) sulfur-containing compounds such as dimethyl sulfoxide, 2,2'-thiodiethanol, and tetramethylene sulfone.

In general, it is desirable to make a pigmented inkjet ink in the form of a concentrated mill grind, which is subsequently diluted to the appropriate concentration for use in the inkjet printing system. This technique permits preparation of a greater quantity of pigmented ink from the equipment. If the mill grind was made in a solvent, it is diluted with water and optionally other solvents to the appropriate concentration. If it was made in water, it is diluted with either additional water or water miscible solvents to the desired concentration. By dilution, the ink is adjusted to the desired viscosity, color, hue, saturation density, and print area coverage for the particular application. The method for the preparation of the mill grind is disclosed in U.S. Pat. Nos. 5,679,138; 5,670,139 and 6,152,999. In a preferred embodiment of the invention, a dispersant is also added to the inkjet ink composition and is used to break down the pigment to sub-micron size during the milling process and keeps the colloidal dispersion stable and free from flocculation for a long period of time.

In the case of organic pigments, the ink may contain up to approximately 30% pigment by weight, but will generally be in the range of approximately 0.1 to 10%, preferably approximately 0.1 to 5%, by weight of the total ink composition for most inkjet printing applications. If an inorganic pigment is selected, the ink will tend to contain higher weight percentages of pigment than with comparable inks employing organic pigments, and may be as high as approximately 75% in some cases, since inorganic pigments generally have higher specific gravities than organic pigments.

The amount of aqueous carrier medium employed is in the range of approximately 70 to 99 weight %, preferably approximately 90 to 98 weight %, based on the total weight of the ink. A mixture of water and a polyhydric alcohol, such as diethylene glycol, is useful as the aqueous carrier medium. In a preferred embodiment, the inks contain from 5 to 60 weight % of water miscible organic solvent. Percentages are based on the total weight of the aqueous carrier medium.

A humectant can be added to the ink composition to help prevent the ink from drying out or crusting in the orifices of the inkjet printhead. Polyhydric alcohol humectants useful in the composition employed in the invention for this purpose include, for example, ethylene glycol, diethylene glycol, triethylene glycol, propylene glycol, tetraethylene glycol, polyethylene glycol, glycerol, 2-methyl-2,4-pentanediol, 1 ,2,6-hexanetriol and thioglycol. The humectant may be employed in a concentration of from 10 to 50% by weight. In a preferred embodiment, diethylene glycol or a mixture of glycerol and diethylene glycol is employed at a concentration of between 10 and 20% by weight.

The ink preferably has physical properties compatible with a wide range of ejecting conditions, i.e., driving voltages and pulse widths for thermal inkjet printing devices, driving frequencies of the piezo element for either a drop-on-demand device or a continuous device, and the shape and size of the nozzle.

A penetrant (0–10% by weight) may also be added to the ink composition employed in the process of the invention to help the ink penetrate the receiving substrate, especially when the substrate is a highly sized paper. A preferred penetrant for the inks employed in the present invention is n-propanol at a final concentration of 1–6% by weight.

A biocide (0.01–1.0% by weight) may also be added to the ink composition employed in the process of the invention to prevent unwanted microbial growth which may occur in the ink over time. A preferred biocide for the inks employed in the present invention is Proxel® GXL (Zeneca Colours Co.) at a concentration of 0.05–0.5% by weight. Additional additives which optionally may be present in inkjet inks include thickeners, conductivity enhancing agents, anti-kogation agents, drying agents, and defoamers.

A polymeric binder may also be added to the pigmented ink. The polymeric binder can be either water soluble or water dispersible. The polymers are generally classified as either condensation polymer or addition polymers. Condensation polymers include, for example, polyesters, polyamides, polyurethanes, polyureas, polyethers, polycarbonates, polyacid anhydrides, and polymers comprising combinations of the above-mentioned types. Addition polymers are polymers formed from polymerization of vinyl-type monomers including, for example, allyl compounds, vinyl ethers, vinyl heterocyclic compounds, styrenes, olefins and halogenated olefins, unsaturated acids and esters derived from them, unsaturated nitrites, vinyl alcohols, acrylamides and methacrylamides, vinyl ketones, multifunctional monomers, or copolymers formed from various combinations of these monomers.

Another aspect of the present invention relates to an inkjet printing method that comprises the steps of: (1) providing an inkjet printer that is responsive to digital data signals; (2) loading said printer with an inkjet recording element as described above, comprising an ink-pigment-trapping surface layer and a porous base unit layer; (3) loading said printer with an inkjet pigment-based ink composition comprising, for example, water, a humectant, and a pigment; and (4) printing on the inkjet recording element using the inkjet ink in response to the digital data signals.

As indicated above, commercially available inkjet printers use several different methods to control the deposition of the ink droplets. Such methods are generally of two types: continuous stream and drop-on-demand.

In drop-on-demand systems, a droplet of ink is ejected from an orifice directly to a position on the ink receiving layer by pressure created by, for example, a piezoelectric device, an acoustic device, or a thermal process controlled in accordance digital data signals. An ink droplet is not generated and ejected through the orifices of the print head unless it is needed. Inkjet printing methods, and related printers, are commercially available and need not be described in detail.

The following examples further illustrate the invention.

EXAMPLE 1

This Example illustrates the properties of some specific examples of porous based unit layer materials suitable for use in the present invention:

Material A: 7 mil Tyvek® non-woven fibrous polyolefin sheet material (commercially available from E. I. Du Pont de Nemours and Company);

Material B: the ink-permeable open cell polyester film developed by Eastman Kodak Company and described in U.S. Pat. No. 6,409,334;

Material C: 0.1 micron MF Millipore® membrane filter (Millipore Corporation). Consisting of a thin (<1 micron) surface layer (with 0.1 micron pores) over a larger pore substrate layer. (For substrate measurements on the 0.1 micron MF Millipore filter, tests were run on the backside of the filter.)

Void volume measurements and median pore size measurements were made via the mercury intrusion porosimetry method with the Micromeritics AutoPore® IV instrument and verified by cross sectional scanning electron micrograph images. Ink drop absorption rate measurements were made using a Brother® 214 piezo inkjet print head firing a 16 pL ink drop onto the substrate. A video camera was used to observe the amount of time required for the ink drop to be absorbed off of the substrate surface. Konica® QP Photo Quality Inkjet Paper (Konica Corporation) and 7 mil Teslin® SP Synthetic Printing Sheet (PPG Industries Inc.) are porous structures that represent control elements since their pore sizes are <100 nm. Void volume, median pore size, and ink drop absorption measurements for these materials are given in Table 1.

TABLE 1

| | | Total Void Volume ($cm^3/m^2$) | Median Pore Diameter (nm) | Ink Drop Absorption Time (msec) |
|---|---|---|---|---|
| 7 mil Tyvek ® fibrous sheet | Invention | 71.2 | 1968 | 22 |
| Voided PET Film | Invention | 47.2 | 1030 | 27 |
| 1.1 MF Millipore ® Membrane Filter (backside) | Invention | 53.7 | 410 | 33 |
| Konica ® QP | Control | 20.3 | 21 | 307 |
| 7 mil Teslin ® SP | Control | 89.9 | 44 | 492 |

The results above clearly show that substrates with large pore sizes (>300 nm) absorb ink much faster.

EXAMPLE 2

This Example illustrates the use, according to the present invention, of a Millipore® membrane filter (Millipore Corporation) as an inkjet receiving element. By surface and cross-sectional SEM analysis, these membrane filters have thin (<1 micron) porous surface or skin layers over a larger porous base unit layer. The filters are rated by the porosity of the surface layer. For example, Millipore Membrane Filters rated with a 0.1 micron pore size have (on average) 0.1 micron pores in the surface layer as seen from surface Scanning Electron Micrographs. In this case, MF-Millipore® membrane filters (mixed cellulose Esters) were used with surface pore sizes ranging from 0.025 microns to 5.0 microns. All membrane filters were printed on the side with the surface or skin layer. The median pore size of the ink-pigment-trapping layer is identified as $r_1$ and the median pore size of the porous base unit layer is identified as $r_2$ The median pore sizes were measured via the mercury intrusion porosimetry method with the Micromeritics AutoPore® IV instrument and verified by cross sectional scanning electron micrograph images.

Printing: Images were printed using an Epson® Stylus C80 desktop printer with pigment based inks in ink cartridges T0322 (cyan) and T0323 (magenta). The median pigment particle sizes of the cyan and magenta inks are about 91 nm (cyan) and 120 nm (magenta) as measured by MICROTRAC II Ultrafine particle analyzer (UPA) manufactured by Leeds & Northrup. The median particle size represents that 50% of the volume in the sample is smaller than the indicated size. The images contained 25%, 50%, 75% and 100% ink coverage blocks of cyan and magenta ink. These blocks were approximately 1 cm by 1 cm in size.

In addition, the images also contained 100% ink coverage blocks of cyan and magenta ink (1 cm by 1.3 cm in size) for measuring printed ink dry time.

Image Density: The cyan and magenta densities of the 100% ink coverage blocks were measured using an X-Rite® densitometer Model 820. The results are shown in the Table 2 below.

Dry Time: Immediately after ejection from the printer, the printed images were placed on a flat surface. An index finger covered with a rubber glove and under average pressure was then wiped across the 1 cm by 1.3 cm 100% color blocks. The dry time was rated as 1 when there was no observed ink smearing and the sample was considered instantly dry. The dry time was rated as a 5 when all of the color blocks easily smeared. Intermediate ink smearing was rated between 1 and 5. The results are shown in Table 2.

TABLE 2

| | Millipore Filter Rating (microns) | Cyan Density | Magenta Density | Approx. Median Pore Size Ratio $r_2/r_1$ | Median Pore Size ($r_1$) to Cyan Pigment Size Ratio | Median Pore Size ($r_1$) to Magenta Pigment Size Ratio | Dry Time |
|---|---|---|---|---|---|---|---|
| Element 1 of the Invention | 0.025 | 1.92 | 2.09 | 16.4 | 0.27 | 0.21 | 1 |
| Element 2 of the Invention | 0.05 | 2.07 | 2.17 | 8.2 | 0.55 | 0.42 | 1 |
| Element 3 of the Invention | 0.10 | 2.05 | 1.89 | 4.1 | 1.10 | 0.83 | 1 |
| Control Element 1 | 0.22 | 0.96 | 0.90 | 1.9 | 2.42 | 1.83 | 1 |
| Control Element 2 | 0.30 | 1.05 | 0.95 | 1.4 | 3.30 | 2.50 | 1 |
| Control Element 3 | 0.45 | 0.97 | 0.95 | 1 | 4.95 | 3.75 | 1 |
| Control Element 4 | 5.0 | 1.00 | 0.97 | 1 | 54.95 | 41.67 | 1 |

The results given in the table above clearly show that significantly higher densities can be obtained with receiver elements when the ratio of the median pore diameter of the ink-pigment-trapping layer to the median particle size of the pigment ink is less than 1.5 and the ratio of the median pore diameter throughout the porous base unit layer to the ink-pigment-trapping surface layer is between 2.0 and 20. In addition, the porous thin surface (skin) layer in combination with relatively large pore underlying substrate allows good dry times.

This invention has been described with particular reference to preferred embodiments thereof but it will be understood that modifications can be made within the spirit and scope of the invention.

What is claimed is:

1. An inkjet recording system comprising:

(a) a pigment-based ink for producing an image on the inkjet recording element; and (b) an inkjet recording element comprising at least two distinct layers:

(i) an ink-pigment-trapping surface layer, said ink-pigment-trapping surface layer having a thickness less than three microns and relatively thinner than an underlying porous base unit layer, wherein the ratio of the median pore diameter of the ink-pigment-trapping surface layer to the median particle size of the pigment ink is less than 1.5;

(ii) a relatively thicker porous base unit layer comprising interconnecting pores throughout the layer, said porous base unit layer having a void volume capable of absorbing essentially all of the applied ink fluids that enter the porous base unit layer, wherein the ratio of the median pore diameter of the porous base unit layer to the median pore diameter of the ink-pigment-trapping surface layer is between 2.0 and 20.

2. The inkjet recording system of claim 1 wherein said ink-pigment-trapping surface layer has a thickness of 0.25 to 2.0 microns.

3. The inkjet recording system of claim 1 wherein the median pore diameter in the ink-pigment-trapping surface layer is less than 500 nm.

4. The inkjet recording system of claim 1 wherein the ratio of the median pore diameter in the ink-pigment-trapping surface layer to the median particle size of the pigment inks is less than 1.1.

5. The inkjet recording system of claim 1 wherein the median pore diameter in the ink-pigment-trapping surface layer is 10 nm to 200 nm.

6. The inkjet recording system of claim 1 wherein the median pore diameter in the ink-pigment-trapping surface layer is 25 nm to 125 nm.

7. The inkjet recording system of claim 1 wherein said porous base unit layer has a total void volume of at least 20 $cm^3/m^2$.

8. The inkjet recording system of claim 1 wherein said porous base unit layer has a total void volume of 40 to 150 $cm^3/m^2$.

9. The inkjet recording system of claim 1 wherein the ratio of the median pore diameter of the porous base unit layer to the median pore diameter of the ink-pigment-trapping surface layer is between 3.5 to 15.

10. The inkjet recording system of claim 1 wherein the median pore diameter of the porous base unit layer is 200 to 3000 nm.

11. The inkjet recording system of claim 1 wherein the median pore diameter of the porous base unit layer is 300 to 2000 nm.

12. The inkjet recording system of claim 1 wherein said porous base unit layer comprises an open-cell voided polymeric film.

13. The inkjet recording system of claim 12 wherein said open-cell voided polymeric film is coextruded with a non-voided polymeric backing film.

14. The inkjet recording system of claim 12 wherein the polymeric film comprises polyester or polyolefin polymers or copolymers.

15. The inkjet recording system of claim 14 wherein the polymeric film comprises PET, polyethylene, polypropylene or copolymers thereof.

16. The inkjet recording system of claim 1 wherein said porous base unit layer comprises cellulosic fiber paper.

17. The inkjet recording system of claim 16 wherein said paper is resin coated with a polyethylene layer on the back.

18. The inkjet recording system of claim 1 wherein said porous base unit layer comprises a synthetic non-woven fibrous sheet optionally overlying a support layer.

19. The inkjet recording system of claim 18 wherein the fibrous sheet is a spun polyolefin.

20. The inkjet recording system of claim 1 wherein said porous base unit layer comprises a foamed film optionally overlying a support.

21. The inkjet recording system of claim 1 wherein said porous base unit layer comprises the portion of a microporous polymeric membrane material below the skin portion, wherein the skin portion is the ink-pigment trapping surface layer, said porous base unit layer optionally overlying a support.

22. The inkjet recording system of claim 21 wherein the microporous polymeric membrane material comprises a phase-inverted material selected from the group consisting of a cellulosic derivative, nylon, polyester, vinyl polymer, and copolymers thereof.

23. The inkjet recording system of claim 22 wherein the microporous polymeric membrane material is selected from the group consisting of polyvinylidene fluoride, polycarbonate, and esters of cellulose.

24. The inkjet recording system of claim 1 wherein said porous base unit layer comprises inorganic particles and/or organic particles, optionally overlying a support.

25. The inkjet recording system of claim 24 wherein said inorganic particles comprise silica, alumina, titanium dioxide, clay, calcium carbonate, barium sulfate zeolites, zinc oxide and/or other oxides.

26. The inkjet recording system of claim 24 wherein said organic particles comprise polyurethane, polyester, or acrylic polymer.

27. The inkjet recording system of claim 1 wherein the porous base unit layer is on a support, which support is selected from the group consisting of cellulosic paper, resin-coated paper, polyester, polyolefin, synthetic paper, and combinations thereof.

28. The inkjet recording system of claim 27, further comprising an antistat or anticurl layer below the support.

29. The inkjet recording system of claim 1 wherein the ink-pigment-trapping surface layer is a fibrous sheet.

30. The inkjet recording system of claim 1 wherein the ink-pigment-trapping surface layer is a fibrous sheet comprising nanofibers or micro fibers.

31. The inkjet recording system of claim 1 wherein the ink-pigment-trapping surface layer is a fibrous sheet comprising a combination of microfibers and nanofibers.

32. The inkjet recording system of claim 29 wherein the fibrous sheet comprises polymeric fibers made by addition or condensation polymerization.

33. The inkjet recording system of claim 29 wherein the fibrous sheet comprises inorganic fibers made from fiberglass, silica, alumina or ceramic.

34. The inkjet recording system of claim 1 wherein the ink-pigment-trapping surface layer comprises inorganic or organic particles.

35. The inkjet recording system of claim 34 wherein said inorganic particles comprise silica, alumina, titanium dioxide, clay, calcium carbonate, barium sulfate, zeolites, zinc oxide and/or other oxides.

36. The inkjet recording system of claim 34 wherein said organic particles comprise polyurethane, polyester, or acrylic polymer.

37. The inkjet recording system of claim 34 further comprising a polymeric binder.

38. The inkjet recording system of claim 37 wherein said polymeric binder is poly(vinyl alcohol), hydroxypropyl cellulose, hydroxypropyl methyl cellulose, a poly(alkylene oxide), poly(vinyl pyrrolidinone), poly(vinyl acetate) or copolymers thereof, and/or gelatin.

39. The inkjet recording system of claim 37 wherein the ink-pigment-trapping surface layer comprises from 50% to 95% by weight of particles and from 50% to 5% by weight of a polymeric binder, based on the total weight of said particles and polymeric binder.

40. The inkjet printing system of claim 37 wherein said polymeric binder comprises a hydrophobic binder.

41. The inkjet printing system of claim 40 wherein said hydrophobic binder comprises poly(styrene-co-butadiene), a polyurethane latex, a polyester latex, poly(n-butyl acrylate), poly(n-butyl methacrylate), poly(2-ethylhexyl acrylate), a copolymer of n-butylacrylate and ethylacrylate, and/or a copolymer of vinylacetate and n-butylacrylate.

42. The inkjet recording system of claim 1 wherein the ink-pigment-trapping surface layer is the skin portion of a microporous polymeric membrane material.

43. The inkjet recording system of claim 1 wherein the ink-pigment-trapping surface layer comprises a polymeric foam.

44. The inkjet recording system of claim 1 wherein the ink-pigment-trapping surface layer comprises a voided polymeric coating.

45. The inkjet recording system of claim 41 wherein the voided polymeric coating comprises a polyolefin or a polyester film voided with inorganic or organic particles.

46. The inkjet recording system of claim 1 wherein the ink-pigment-trapping surface layer further comprises a mordant for providing pigment affinity for the layer.

47. The inkjet recording system of claim 46 wherein the mordant comprises a cationic or anionic functionality depending on the charge of the ink pigments.

48. The inkjet printing system of claim 1 where the said pigment comprises a self-dispersing pigment, an encapsulated pigment, or a pigment dispersed by a dispersant.

49. An inkjet printing method, comprising the steps of:

a) providing an inkjet printer that is responsive to digital data signals;

b) loading said printer with an inkjet recording element according to claim 1;

c) loading said printer with said pigment-based ink, which comprises water, humectant, and a pigment; and d) printing on said ink-recording element using said pigment-based ink in response to said digital data signals.

* * * * *